US006171204B1

(12) United States Patent
Starry

(10) Patent No.: US 6,171,204 B1
(45) Date of Patent: Jan. 9, 2001

(54) GOLF CLUB HEAD

(76) Inventor: Frederick B. Starry, 6539 S. Front Rd. Space #1, Livermore, CA (US) 94550

( * ) Notice: Under 35 U.S.C. 154(b), the term of this patent shall be extended for 0 days.

(21) Appl. No.: 09/262,202

(22) Filed: Mar. 4, 1999

(51) Int. Cl.[7] ..... A63B 53/04
(52) U.S. Cl. ..... 473/333; 473/256
(58) Field of Search ..... 473/333, 334, 473/335, 336, 337, 338, 339, 256, 329, 324, 350

(56) References Cited

U.S. PATENT DOCUMENTS 690,940 * 1/1902 Febiger .
1,825,244 * 9/1931 Nero .
1,975,307 * 10/1934 Ackerman .
2,592,013 * 4/1952 Curley .
2,750,194 * 6/1956 Clark .
3,589,731 * 6/1971 Chancellor .
4,461,481 * 7/1984 Kim .
5,121,922 * 6/1992 Harsh .

* cited by examiner

*Primary Examiner*—Sebastiano Passaniti

(57) ABSTRACT

A golf club head for increasing the distance a golf ball travels after being struck with the golf club head. The golf club head includes a body with a striking face and a back face. The body has a cavity therein that has a forwards face adjacent the striking face of the body and a rearwards face adjacent the back face of the body. A block is disposed in the cavity of the body. The block has opposite first and second faces. The first face of the block faces the forwards face of the cavity and the second face of the block faces the rearwards face of the cavity. The block is biased towards the rearwards face of the cavity so that the block is biased to a position where the first face of the block is spaced apart from the forwards face of the cavity.

7 Claims, 2 Drawing Sheets

GOLF CLUB HEAD

BACKGROUND OF THE INVENTION

1. Field of the Invention

The present invention relates to golf club heads and more particularly pertains to a new golf club head for increasing the distance a golf ball travels after being struck with the golf club head.

2. Description of the Prior Art

The use of golf club heads is known in the prior art. More specifically, golf club heads heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,825,244 by Nero; U.S. Pat. No. 4,461,481 by Kim; U.S. Pat. No. 3,589,731 by Chancellor, Jr.; U.S. Pat. No. Des. 355,234 by MacNally et al.; U.S. Pat. No. 1,975,307 by Ackerman; and U.S. Pat. No. 5,121,922 by Harsh, Sr.

While these devices fulfill their respective, particular objectives and requirements, the aforementioned patents do not disclose a new golf club head. The inventive device includes a body with a striking face and a back face. The body has a cavity therein that has a forwards face adjacent the striking face of the body and a rearwards face adjacent the back face of the body. A block is disposed in the cavity of the body. The block has opposite first and second faces. The first face of the block faces the forwards face of the cavity and the second face of the block faces the rearwards face of the cavity. The block is biased towards the rearwards face of the cavity so that the block is biased to a position where the first face of the block is spaced apart from the forwards face of the cavity.

In these respects, the golf club head according to the present invention substantially departs from the conventional concepts and designs of the prior art, and in so doing provides an apparatus primarily developed for the purpose of increasing the distance a golf ball travels after being struck with the golf club head.

SUMMARY OF THE INVENTION

In view of the foregoing disadvantages inherent in the known types of golf club heads now present in the prior art, the present invention provides a new golf club head construction wherein the same can be utilized for increasing the distance a golf ball travels after being struck with the golf club head.

The general purpose of the present invention, which will be described subsequently in greater detail, is to provide a new golf club head apparatus and method which has many of the advantages of the golf club heads mentioned heretofore and many novel features that result in a new golf club head which is not anticipated, rendered obvious, suggested, or even implied by any of the prior art golf club heads, either alone or in any combination thereof.

To attain this, the present invention generally comprises a body with a striking face and a back face. The body has a cavity therein that has a forwards face adjacent the striking face of the body and a rearwards face adjacent the back face of the body. A block is disposed in the cavity of the body. The block has opposite first and second faces. The first face of the block faces the forwards face of the cavity and the second face of the block faces the rearwards face of the cavity. The block is biased towards the rearwards face of the cavity so that the block is biased to a position where the first face of the block is spaced apart from the forwards face of the cavity.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf club head apparatus and method which has many of the advantages of the golf club heads mentioned heretofore and many novel features that result in a new golf club head which is not anticipated, rendered obvious, suggested, or even implied by any of the prior art golf club heads, either alone or in any combination thereof.

It is another object of the present invention to provide a new golf club head which may be easily and efficiently manufactured and marketed.

It is a further object of the present invention to provide a new golf club head which is of a durable and reliable construction.

An even further object of the present invention is to provide a new golf club head which is susceptible of a low cost of manufacture with regard to both materials and labor, and which accordingly is then susceptible of low prices of sale to the consuming public, thereby making such golf club head economically available to the buying public.

Still yet another object of the present invention is to provide a new golf club head which provides in the apparatuses and methods of the prior art some of the advantages thereof, while simultaneously overcoming some of the disadvantages normally associated therewith.

Still another object of the present invention is to provide a new golf club head for increasing the distance a golf ball travels after being struck with the golf club head.

Yet another object of the present invention is to provide a new golf club head which includes a body with a striking face and a back face. The body has a cavity therein that has a forwards face adjacent the striking face of the body and a rearwards face adjacent the back face of the body. A block is disposed in the cavity of the body. The block has opposite first and second faces. The first face of the block faces the forwards face of the cavity and the second face of the block faces the rearwards face of the cavity. The block is biased towards the rearwards face of the cavity so that the block is biased to a position where the first face of the block is spaced apart from the forwards face of the cavity.

Still yet another object of the present invention is to provide a new golf club head that let a golfer strike a golf ball with less effort to have the golf ball travel a greater distance and thereby the golfer may focus on the accuracy of the shot rather than the force of the shot.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 3*c* thereof, a new golf club head embodying the principles and concepts of the present invention will be described.

As best illustrated in FIGS. 1 through 3*c*, the golf club head generally comprises a body with a striking face and a back face. The body has a cavity therein that has a forwards face adjacent the striking face of the body and a rearwards face adjacent the back face of the body. A block is disposed in the cavity of the body. The block has opposite first and second faces. The first face of the block faces the forwards face of the cavity and the second face of the block faces the rearwards face of the cavity. The block is biased towards the rearwards face of the cavity so that the block is biased to a position where the first face of the block is spaced apart from the forwards face of the cavity.

Figure 3A:
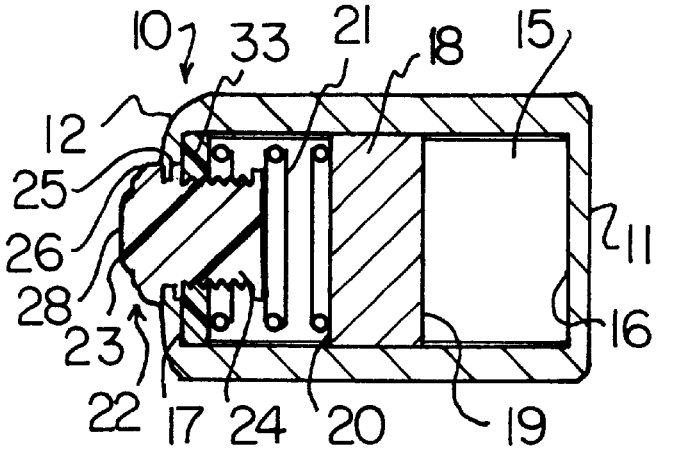
FIG. 3*a* is a schematic cross sectional view of a preferred spring embodiment of the present invention taken from line 3—3 of FIG. 2 with the block in its biased position where the first face of the block is spaced apart from the forwards face of the cavity.
Figure 3B:
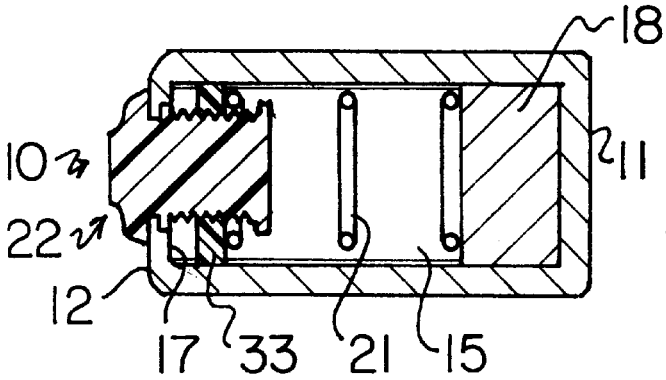
FIG. 3*b* is a schematic cross sectional view of the preferred embodiment in FIG. 3*a* taken from line 3—3 of FIG. 2 with the block in a position against the forwards face of the cavity at the time of impact of the striking face of the body with an object such as a golf club.
Figure 3C:
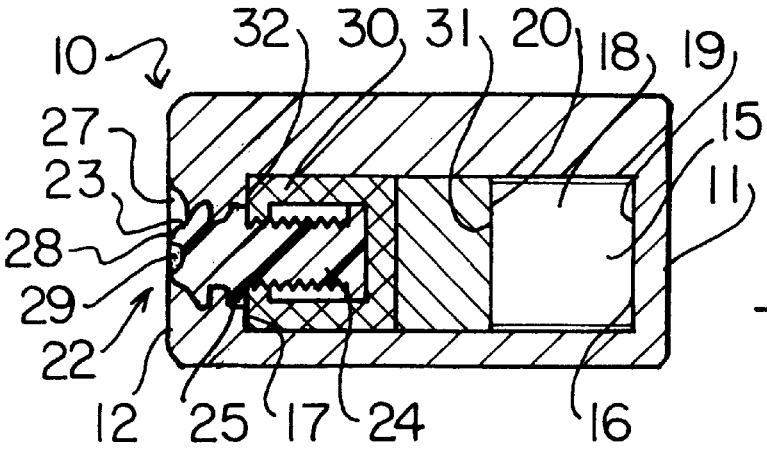
FIG. 3*c* is a schematic cross sectional view of the magnetic preferred embodiment of the present invention taken from line 3—3 of FIG. 2 with the block in its biased position where the first face of the block is spaced apart from the forwards face of the cavity.

In closer detail, the golf club head comprises a body 10 with a generally flat striking face 11 and a rounded back face 12. The golf club head is preferably either a wood- or a putter-style golf club head with a neck 13 or hosel designed for receiving an end of a golf club shaft 14 therein. As illustrated in FIGS. 3*a*–*c*, the body has a generally rectangular box-shaped cavity 15 therein. The cavity has a forwards face 16 adjacent the striking face of the body and a rearwards face 17 adjacent the back face of the body.

A generally rectangular block 18 is disposed in the cavity of the body. The block has opposite first and second faces 19,20. The first face of the block faces towards the forwards face of the cavity while the second face of the block faces towards the rearwards face of the cavity. The block is biased towards the rearwards face of the cavity so that the block is biased to a position where the first face of the block is spaced apart from the forwards face of the cavity (see FIGS. 3*a* and 3*c*). In use, swinging of the body such that the striking face of the body strikes an object such as a golf ball with a predetermined amount of force moves the block forwards towards the striking face of the body until the first face of the block strikes the forwards face of the cavity (see FIG. 3*b*) and thereby transfer additional momentum to drive the struck object the golf ball even further than if struck by a similar body without the block therein. After the object is struck with the striking face, the biasing force pulls the block back towards the rearwards face of the cavity to space the first face of the block away from the forwards face of the cavity so that the golf club head is ready for another swing.

With reference to FIGS. 3*a* and 3*b*, in one preferred embodiment, a spring 21 biases the block towards the rearwards face of the cavity. Ideally, the spring comprises a coiled spring disposed in the cavity of the body between the rearwards face of the cavity and the second face of the block. The spring is coupled to the second face of the block. In this embodiment, a tension ring 33 is disposed in the cavity of the body. The tension ring is positioned between the rearwards face of the cavity and the spring and the spring is coupled to the tension ring.

The tension ring has a threaded interior circumference defining a threaded central hole through the tension ring. The body has a bore extending between the back face of the body and the rearwards face of the cavity. The tension ring is positioned adjacent the bore of the body such that the bore of the body and the central hole of the tension ring are coaxial with one another.

A tension adjuster 22 is provided having a turning head portion 23 and a threaded portion 24. As illustrated in FIGS. 3*a* and 3*b*, the tension adjuster is extended through the bore of the body. The tension adjuster is rotatably mounted in the bore of the body by an annular flange 25 on the tension adjuster to permit rotation of the tension adjuster about an axis of the bore. The threaded portion of the tension adjuster is extended into the cavity of the body and threadably inserted through the central hole of the tension ring.

In use, rotation of the tension adjuster in a first direction advances the tension ring on the threaded portion of the tension adjuster towards the forwards face of the cavity. Advancing the tension ring towards the forwards face of the cavity in turn moves the block towards the forwards face of the cavity to reduce the space between the first face of the block and the forwards face of the cavity so that the block travels less distance when the body is swung to strike an object with the striking face of the body.

Conversely, rotation of the tension adjuster in a second direction opposite the first direction advances the tension ring on the threaded portion of the tension adjuster towards the rearwards face of the cavity. Advancing the tension ring towards the rearwards face of the cavity in turn moves the block away from the forwards face of the cavity to increase the space between the first face of the block and the forwards face of the cavity so that the block has to travel more distance when the body is swung to strike an object with the striking face of the body.

Figure 1:
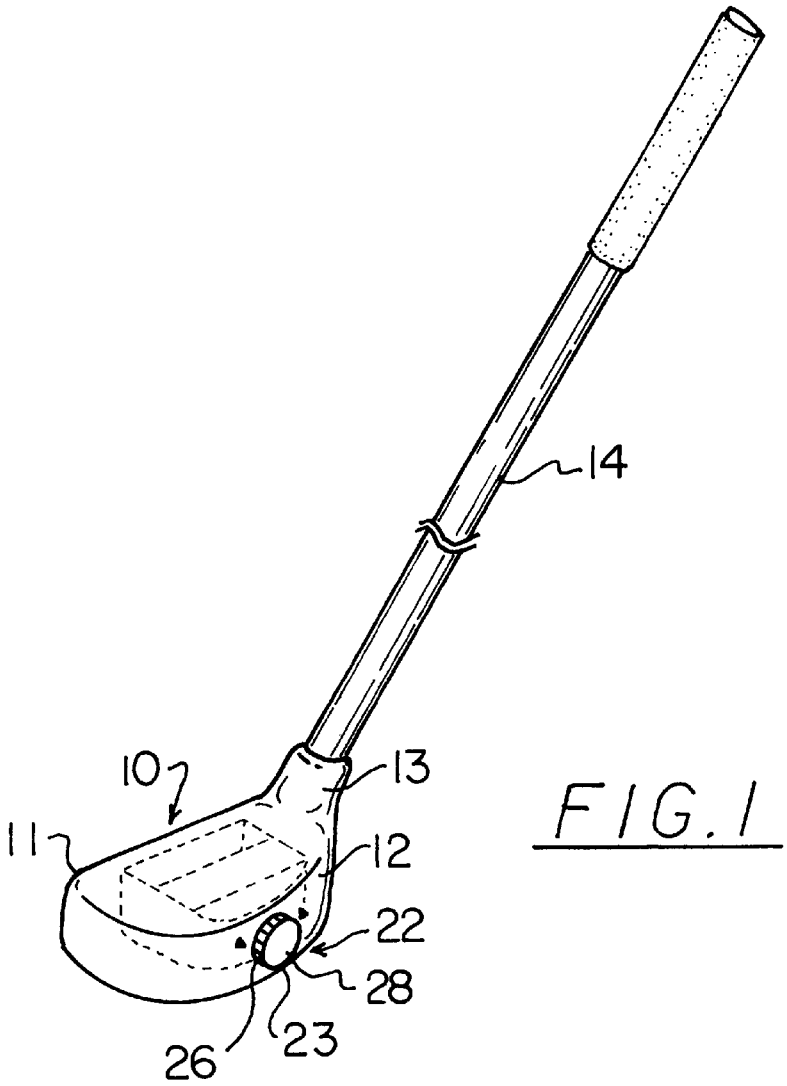
FIG. 1 is a schematic rear perspective view of a new golf club head attached to a golf club shaft according to the present invention.
Figure 2:
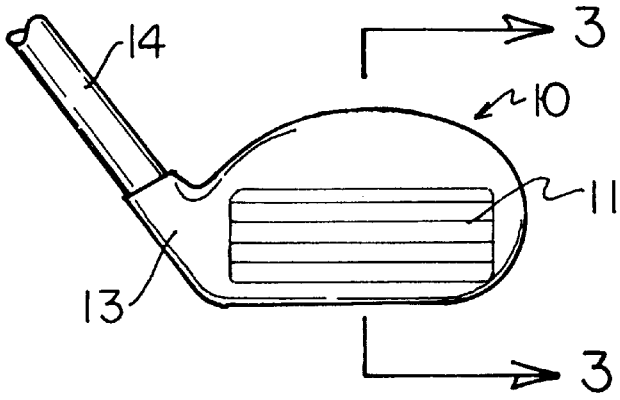
FIG. 2 is a schematic front view of the present invention.

The turning head portion of the tension adjuster faces outwardly from the back face of the body. In one preferred embodiment, as illustrated in FIGS. 1, 3*a*, and 3*b*, the turning head portion of the tension adjuster has an annular outer side 26 with a plurality of grooves or ridges for frictionally enhancing contact between the outer side of the turning head portion and a user's fingers grasping the outer side of the turning head portion to rotate the tension adjuster. Optionally, as illustrated in FIG. 3*c*, the back face of the body may have an annular recess 27 about the bore of the body with the turning head portion of the tension adjuster being located in the recess of the back face of the body. In this optional embodiment, the turning head portion has an generally circular outer face 28 lying flush with the back face of the body portion. The outer face of the turning head portion has a slot 29 therein designed for receiving a head of a screwdriver, a fingernail, or an edge of a coin therein to permit turning of the tension adjuster with the object inserted into the slot.

In another preferred embodiment illustrated in FIG. 3*c*, a magnet 30 biases the block towards the rearwards face of the cavity. In this embodiment, the block comprises a magnetizable material attracted to the magnet. The magnet is disposed in the cavity of the body between the rearwards face of the cavity and the second face the block. The magnet has a front face 31 facing the second face of the block and a back face 32 facing the rearwards face of the cavity. The back face of the magnet has a threaded hole into the magnet. Like the other preferred embodiment, the body has a bore extending between the back face of the body and the rearwards face of the cavity. In this embodiment, the back face of the magnet is positioned adjacent the bore of the body such that the bore of the body and the threaded hole of the magnet are coaxial with one another.

Also included in this preferred embodiment is a tension adjuster having a turning head portion and a threaded portion. The tension adjuster is extended through the bore of the body and rotatably mounted in the bore of the body by an annular flange on the tension adjuster to permit rotation of the tension adjuster about an axis of the bore. In this embodiment, the threaded portion of the tension adjuster is threadably inserted through the threaded hole of the magnet into the magnet. In use, rotation of the tension adjuster in a first direction advances the magnet on the threaded portion of the tension adjuster towards the forwards face of the cavity. Advancing the magnet towards the forwards face of the cavity in turn moves the block towards the forwards face of the cavity to reduce the space between the first face of the block and the forwards face of the cavity so that the block travels less distance when the body is swung to strike an object with the striking face of the body. Conversely, rotation of the tension adjuster in a second direction opposite the first direction advances the magnet on the threaded portion of the tension adjuster towards the rearwards face of the cavity. Advancing the magnet towards the rearwards face of the cavity in turn moves the block away from the forwards face of the cavity to increase the space between the first face of the block and the forwards face of the cavity so that the block has to travel more distance when the body is swung to strike an object with the striking face of the body.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf club head, comprising:

a body having a striking face and a back face;

said body having a cavity therein, said cavity having a forwards face adjacent said striking face of said body and a rearwards face adjacent said back face of said body;

a block being disposed in said cavity of said body, said block having opposite first and second faces, said first face of said block facing said forwards face of said cavity, said second face of said block facing said rearwards face of said cavity;

said block being biased towards said rearwards face of said cavity so that said block is biased to a position where said first face of said block is spaced apart from said forwards face of said cavity;

wherein swinging of said body such that said striking face of said body strikes an object with a predetermined amount of force moves said block towards said striking face of said body until said first face of said block strikes said forwards face of said cavity;

wherein a spring biases said block towards said rearwards face of said cavity;

wherein said spring is disposed in said cavity of said body between said rearwards face of said cavity and said second face of said block, and wherein said spring is coupled to said second face of said block;

a tension ring being disposed in said cavity of said body, said tension ring being positioned between said rearwards face of said cavity and said spring, and wherein said spring is coupled to said tension ring; and wherein said tension ring has a threaded interior circumference defining a threaded central hole through said tension ring wherein said body has a bore extending between said back face of said body and said rearwards face of said cavity, wherein said tension ring is positioned adjacent said bore of said body such that said bore of said body and said central hole of said tension ring are coaxial with one another, wherein a tension adjuster is provided having a turning head portion and a threaded portion, wherein said tension adjuster is extended through said bore of said body, wherein said tension adjuster is rotatable mounted in said bore of said body to permit rotation of said tension adjuster about an axis of said bore, and wherein said threaded portion of said tension adjuster is extended into said cavity of said body and threadably inserted through said central hole of said tension ring.

2. The golf club head of claim 1, wherein rotation of said tension adjuster in a first direction advances said tension ring on said threaded portion of said tension adjuster towards said forwards face of said cavity, and wherein rotation of said tension adjuster in a second direction opposite said first direction advances said tension ring on said threaded portion of said tension adjuster towards said rearwards face of said cavity.

3. The golf club head of claim 1, wherein said turning head portion of said tension adjuster faces outwardly from said back face of said body.

4. The golf club head of claim 3, wherein said turning head portion of said tension adjuster has an annular outer side, said outer side of said turning head portion having a plurality of groove therein.

5. The golf club head of claim 3, wherein said back face of said body has an annular recess about said bore of said body, wherein said turning head portion of said tension adjuster is located in said recess of said back face of said body, wherein said turning head portion has an outer face, and wherein said outer face of said turning head portion has a slot therein.

6. A golf club head, comprising:

a body having a generally flat striking face and a rounded back face;

said body having a generally rectangular box-shaped cavity therein, said cavity having a forwards face adjacent said striking face of said body and a rearwards face adjacent said back face of said body;

a generally rectangular block being disposed in said cavity of said body, said block having opposite first and second faces, said first face of said block facing said forwards face of said cavity, said second face of said block facing said rearwards face of said cavity;

said block being biased towards said rearwards face of said cavity so that said block is biased to a position where said first face of said block is spaced apart from said forwards face of said cavity;

wherein swinging of said body such that said striking face of said body strikes an object with a predetermined amount of force moves said block towards said striking face of said body until said first face of said block strikes said forwards face of said cavity;

wherein a spring biases said block towards said rearwards face of said cavity;

said spring being disposed in said cavity of said body between said rearwards face of said cavity and said second face of said block;

said spring being coupled to said second face of said block;

a tension ring being disposed in said cavity of said body, said tension ring being positioned between said rearwards face of said cavity and said spring;

said spring being coupled to said tension ring;

said tension ring having a threaded interior circumference defining a threaded central hole through said tension ring;

said body having a bore extending between said back face of said body and said rearwards face of said cavity;

said tension ring being positioned adjacent said bore of said body such that said bore of said body and said central hole of said tension ring are coaxial with one another;

a tension adjuster having a turning head portion and a threaded portion;

said tension adjuster being extended through said bore of said body, said tension adjuster being rotatably mounted in said bore of said body to permit rotation of said tension adjuster about an axis of said bore;

said threaded portion of said tension adjuster being extended into said cavity of said body and threadably inserted through said central hole of said tension ring;

wherein rotation of said tension adjuster in a first direction advances said tension ring on said threaded portion of said tension adjuster towards said forwards face of said cavity, wherein rotation of said tension adjuster in a second direction opposite said first direction advances said tension ring on said threaded portion of said tension adjuster towards said rearwards face of said cavity;

said turning head portion of said tension adjuster facing outwardly from said back face of said body;

said back face of said body having an annular recess about said bore of said body, said turning head portion of said tension adjuster being located in said recess of said back face of said body;

said turning head portion having an outer face; and said outer face of said turning head portion having a slot therein.

7. A golf club head, comprising:

a body having a striking face and a back face;

said body having a cavity therein, said cavity having a forwards face adjacent said striking face of said body and a rearwards face adjacent said back face of said body;

a block being disposed in said cavity of said body, said block having opposite first and second faces, said first face of said block facing said forwards face of said cavity, said second face of said block facing said rearwards face of said cavity;

said block being biased towards said rearwards face of said cavity so that said block is biased to a position where said first face of said block is spaced apart from said forwards face of said cavity;

wherein swinging of said body such that said striking face of said body strikes an object with a predetermined amount of force moves said block towards said striking face of said body until said first face of said block strikes said forwards face of said cavity;

wherein a magnet biases said block towards said rearwards face of said cavity;

wherein said magnet is disposed in said cavity of said body between said rearwards face of said cavity and said second face said block, wherein said magnet has a front face facing said second face of said block and a back face facing said rearwards face of said cavity; and wherein said back face of said magnet has a threaded hole into said magnet, wherein said body has a bore extending between said back face of said body and said rearwards face of said cavity, wherein said back face of said magnet is positioned adjacent said bore of said body such that said bore of said body and said threaded hole of said magnet are coaxial with one another, wherein a tension adjuster is provided having a turning head portion and a threaded portion, wherein said tension adjuster is extended through said bore of said body, wherein said tension adjuster is rotatably mounted in said bore of said body to permit rotation of said tension adjuster about an axis of said bore, wherein said threaded portion of said tension adjuster is threadably inserted through said threaded hole of said magnet into said magnet, wherein rotation of said tension adjuster in a first direction advances said magnet on said threaded portion of said tension adjuster towards said forwards face of said cavity, and wherein rotation of said tension adjuster in a second direction opposite said first direction advances said magnet on said threaded portion of said tension adjuster towards said rearwards face of said cavity.

* * * * *